US009920949B2

(12) United States Patent
Xiong et al.

(10) Patent No.: US 9,920,949 B2
(45) Date of Patent: Mar. 20, 2018

(54) AIR CONDITIONING SYSTEM AND ENERGY MANAGEMENT METHOD OF AIR CONDITIONING SYSTEM

(71) Applicants: GD MIDEA HEATING & VENTILATING EQUIPMENT CO., LTD., Foshan (CN); MIDEA GROUP CO., LTD., Foshan (CN)

(72) Inventors: Meibing Xiong, Foshan (CN); Yongfeng Xu, Foshan (CN); Xihua Ma, Foshan (CN); Weilong Hu, Foshan (CN)

(73) Assignees: GD Midea Heating & Ventilating Equipment Co., Ltd., Foshan (CN); Midea Group Co., Ltd., Foshan (CN)

( * ) Notice: Subject to any disclaimer, the term of this patent is extended or adjusted under 35 U.S.C. 154(b) by 259 days.

(21) Appl. No.: 14/753,591

(22) Filed: Jun. 29, 2015

(65) Prior Publication Data

US 2016/0356520 A1 Dec. 8, 2016

(30) Foreign Application Priority Data

Jun. 3, 2015 (CN) ..... 2015 1 0300685

(51) Int. Cl.

| | |
|---|---|
| ***F24F 3/00*** | (2006.01) |
| ***F24F 11/08*** | (2006.01) |
| ***F24F 11/00*** | (2018.01) |

(52) U.S. Cl.

CPC ..... *F24F 11/08* (2013.01); *F24F 11/0012* (2013.01); *F24F 2011/0075* (2013.01)

(58) Field of Classification Search

USPC ..... 62/127, 225; 236/1 C

See application file for complete search history.

(56) References Cited

U.S. PATENT DOCUMENTS 4,060,123 A * 11/1977 Hoffman ..... F24D 19/10 165/11.1
5,568,733 A * 10/1996 Toyota ..... F24F 11/0009 236/78 D (Continued)

FOREIGN PATENT DOCUMENTS

| | | | | |
|---|---|---|---|---|
| EP | 2863153 | A1 * | 4/2015 | ..... F25B 13/00 |
| JP | 09-152173 | A | 6/1997 | |
| JP | 2000-097473 | A | 4/2000 | |

OTHER PUBLICATIONS

Chinese Patent Application No. 20151300685.6 Office Action dated May 3, 2017 with English Translation, 22 pages.

*Primary Examiner* — David Teitelbaum
*Assistant Examiner* — Paul Schwarzenberg
(74) *Attorney, Agent, or Firm* — Lathrop Gage LLP

(57) ABSTRACT

In an air conditioning system of the present disclosure, the controlling module determines state of the indoor unit. If the indoor unit is under off state, the controlling module determines whether an indoor temperature is smaller than a preset temperature. If yes, the controlling module controls the indoor unit to heat according to a first heating temperature. If the indoor unit is under heating state, the controlling module sets a second heating temperature of the indoor unit to the first heating temperature, and controls the indoor unit to heat according to the first heating temperature. The first heating temperature is smaller than the second heating temperature. If the indoor unit is under cooling state, the controlling module sets a first cooling temperature to a second cooling temperature which is greater than the first cooling temperature, and controls the indoor unit to cool according to the second cooling temperature.

8 Claims, 2 Drawing Sheets

(56) References Cited

U.S. PATENT DOCUMENTS

| | | | | |
|---|---|---|---|---|
| 5,775,116 | A * | 7/1998 | Matsumoto | F24F 11/0009 62/128 |
| 2008/0283621 | A1* | 11/2008 | Quirino | F24F 11/0034 236/1 C |
| 2014/0010260 | A1* | 1/2014 | McMillan | F24F 11/006 374/102 |

* cited by examiner

AIR CONDITIONING SYSTEM AND ENERGY MANAGEMENT METHOD OF AIR CONDITIONING SYSTEM

CROSS-REFERENCE TO RELATED APPLICATION

This application claims priority to and benefits of Chinese Patent Application Serial No. 201510300685.6, filed with the State Intellectual Property Office of P. R. China on Jun. 3, 2015, the entire contents of which are incorporated herein by reference.

FIELD

The present disclosure relates to air conditioning field, and more particularly, to an air conditioning system and an energy management method of an air conditioning system.

BACKGROUND

Currently, with the improved people's life, an air conditioning system is becoming more and more popular with people. Generally, the air conditioning system is installed to various indoor places, such as offices, conference rooms and homes, and other places. When the air conditioning system is used in the indoor places, such as the offices or the conference rooms, after people leaves the place, it is not allowed to turn off the air conditioning system because of requirements of comfort and safety (waterway of the air conditioning system needs to be anti-frozen in the winter).

However, at this time, if the air conditioning system operates according to the way when people stay in the places, this is a great waste of energy. Therefore, people need to set the air conditioning system repeatedly to solve energy-saving problem of the air conditioning system when people leave the indoor place. The air condition system becomes user-unfriendly.

SUMMARY

The present disclosure aims to solve one of the technical problems at least to some extent. Therefore, it is an objective of the present disclosure to provide an air conditioning system and an energy management method of air conditioning system.

An air conditioning system includes a controller and an indoor unit. The indoor unit includes a controlling module. The controller is configured to send an energy control signal to the controlling module. The controlling module is configured to receive the energy control signal and determine current state of the indoor unit according to the energy control signal.

If the indoor unit is under off state, the controlling module is configured to maintain the off state of the indoor unit, and determine whether an indoor temperature is smaller than a preset temperature.

If the indoor temperature is smaller than the preset temperature, the controlling module is configured to control the indoor unit to heat according to a first heating temperature, and increase a target degree of subcooling of the indoor unit. If the indoor temperature is not smaller than the preset temperature, the controlling module is configured to maintain the off state of the indoor unit.

If the indoor unit is under heating state, the controlling module is configured to set a second heating temperature of the indoor unit to the first heating temperature, and control the indoor unit to heat according to the first heating temperature, and increase the target degree of subcooling of the indoor unit. The first heating temperature is smaller than the second heating temperature.

If the indoor unit is under cooling state, the controlling module is configured to set a first cooling temperature of the indoor unit to a second cooling temperature and control the indoor unit to cool according to the second cooling temperature, and increase an objective superheating degree of the indoor unit. The second cooling temperature is greater than the first cooling temperature.

In the air conditioning system, when receiving the energy control signal of the user, the controlling module controls the indoor unit to operate according to different states of the indoor unit. This can balance the cooling comfort and energy saving problems of the air conditioning system in the summer, and balance anti-freezing and energy saving problems of the air conditioning system in the winter.

In one embodiment, if the indoor unit is under fan state, the controlling module is configured to turn off the indoor unit, and determine whether the indoor temperature is smaller than the preset temperature. If the indoor temperature is smaller than the preset temperature, the controlling module is configured to control the indoor unit to heat according to the first heating temperature, and increase the target degree of subcooling of the indoor unit. If the indoor temperature is not smaller than the preset temperature, the controlling module is configured to maintain the off state of the indoor unit.

In one embodiment, if the indoor unit is under dry state, the controlling module is configured to turn off the indoor unit and determine whether the indoor temperature is smaller than the preset temperature. If the indoor temperature is smaller than the preset temperature, the controlling module is configured to control the indoor unit to heat according to the first heating temperature, and increase the target degree of subcooling of the indoor unit. If the indoor temperature is not smaller than the preset temperature, the controlling module is configured to maintain the off state of the indoor unit.

In one embodiment, the air conditioning system includes an outdoor unit. When the controlling module controls the indoor unit to heat according to the first heating temperature, the controlling module is configured to send a first heating demand to the outdoor unit. The controlling module is further configured to reduce the first heating demand to a second heating demand, and send the second heating demand to the outdoor unit. When the controlling module controls the indoor unit to cool according to the second cooling temperature, the controlling module is configured to send a first cooling demand to the outdoor unit. The controlling module is further configured to reduce the first cooling demand to a second cooling demand, and send the second cooling energy to the outdoor unit.

In one embodiment, the second heating demand is 30% of the first heating demand, and the second cooling demand is 30% of the first cooling demand.

An energy management method of an air conditioning system is provided. The air condition system includes a controller and an indoor unit. The indoor unit includes a controlling module. The energy management method includes following steps of:

S1: the controller sending an energy control signal to the controlling module;

S2: the controlling module receiving the energy control signal and determining current state of the indoor unit according to the energy control signal, if the indoor unit is under off state, entering step S3, and if the indoor unit is under heating state, entering step S4, and if the indoor unit is under cooling state, entering step S5;

S3: the controlling module maintaining the off state of the indoor unit, and determining whether an indoor temperature is smaller than a preset temperature, if the indoor temperature is smaller than the preset temperature, entering step S6, if the indoor temperature is not smaller than the preset temperature, continuing the step S3;

S4: the controlling module setting a second heating temperature of the indoor unit to a first heating temperature, and entering the step S6;

S5: the controlling module setting a first cooling temperature of the indoor unit to a second cooling temperature and controlling the indoor unit to cool according to the second cooling temperature, and increasing a target degree of superheating of the indoor unit, the second cooling temperature being greater than the first cooling temperature;

S6: the controlling module controlling the indoor unit to heat according to the first heating temperature, and increasing the target degree of subcooling of the indoor unit, the first heating temperature being smaller than the second heating temperature.

In the energy management method of the air conditioning system, when receiving the energy control signal of the user, the controlling module controls the indoor unit to operate according to different states of the indoor unit. This can balance the cooling comfort and energy saving problems of the air conditioning system in the summer, and balance anti-freezing and energy saving problems of the air conditioning system in the winter.

In one embodiment, the step S1 includes: if the indoor unit is under fan state, entering step S7. The energy management method includes a step of:

S7: the controlling module turning off the indoor unit, and determining whether the indoor temperature is smaller than the preset temperature, if the indoor temperature is smaller than the preset temperature, entering the step S6, if the indoor temperature is not smaller than the preset temperature, continuing the step S7.

In one embodiment, the step S1 includes: if the indoor unit is under dry state, entering step S7. The energy management method includes a step of:

S7: the controlling module turning off the indoor unit and determining whether the indoor temperature is smaller than the preset temperature, if the indoor temperature is smaller than the preset temperature, entering the step S6, if the indoor temperature is not smaller than the preset temperature, continuing the step S7.

In one embodiment, the air conditioning system includes an outdoor unit. The step S6 includes: when the controlling module controls the indoor unit to heat according to the first heating temperature, the controlling module sending a first heating demand to the outdoor unit. After the step S6, the energy management method further includes a step of:

S8: the controlling module reducing the first heating demand to a second heating demand, and sending the second heating demand to the outdoor unit.

The step S5 includes: when the controlling module controls the indoor unit to cool according to the second cooling temperature, the controlling module sending a first cooling demand to the outdoor unit.

After the step S5, the energy management method further includes a step of:

S9: the controlling module reducing the first cooling demand to a second cooling demand, and sending the second cooling demand to the outdoor unit.

In one embodiment, the second heating demand is 30% of the first heating demand, and the second cooling demand is 30% of the first cooling demand.

Additional aspects and advantages of the embodiments of the present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of the disclosure will become apparent and more readily appreciated from the following descriptions taken in conjunction with the drawings in which.

DETAILED DESCRIPTION

Figure 1:
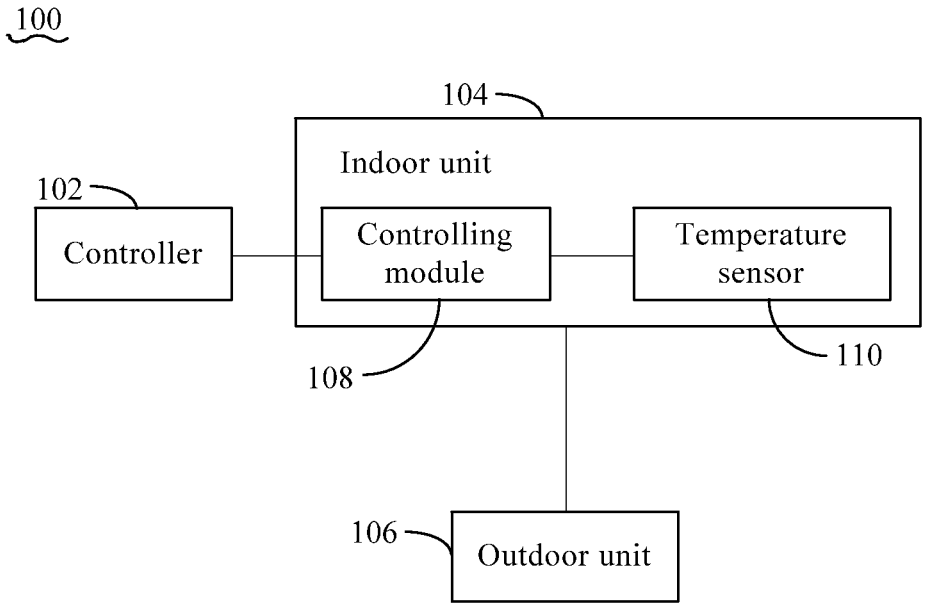
FIG. 1 is a block diagram of the air conditioning system, according to an embodiment of the present disclosure.

Embodiments of the present disclosure will be described in detail in the following descriptions, examples of which are shown in the accompanying drawings, in which the same or similar elements and elements having same or similar functions are denoted by like reference numerals throughout the descriptions. The embodiments described herein with reference to the accompanying drawings are explanatory and illustrative, which are used to generally understand the present disclosure. The embodiments shall not be construed to limit the present disclosure.

In descriptions of the present disclosure, terms such as "first" and "second" are used herein for purposes of description and are not intended to indicate or imply relative importance or significance or imply a number of technical features indicated. Therefore, a "first" or "second" feature may explicitly or implicitly include one or more features. Further, in the description, unless indicated otherwise, "a number of" refers to two or more.

In the present disclosure, unless indicated otherwise, terms such as "install", "connect", "fix", etc., should be understood broadly. For example, it can be a fixed connection, it also can be a detachable connection or an integration. It can be a mechanical connection, or can be an electrical connection. It can be a direct connection and also can be an indirect connection through an intermediate media. It can be a connection inside two elements or mutual relationships of two elements, unless indicated otherwise. For those skilled in the art, specific meaning of the above terms in the present disclosure can be understood according to specific situations.

In the present disclosure, unless indicated otherwise, a first feature "on" or "under" a second feature may include an embodiment in which the first feature directly contacts the second feature, and may also include an embodiment in which an additional feature is formed between the first feature and the second feature so that the first feature does not directly contact the second feature.

Referring to FIG. 1, an air conditioning system 100, according to an embodiment of the present disclosure, includes a controller 102, an indoor unit 104 and an outdoor unit 106. The air conditioning system 100 can be applied to central air conditioning field.

The controller 102 is configured to send an energy control signal to the indoor unit 104. The controller 102 can be an online controller or other controllers. For example, the online controller may an electronic device, such as a cell phone, a tablet computer, etc., which is capable of transmitting data by wireless way. These electronic devices can run a control application for air conditioning, and the control application has a controller interface. The controller interface may include an "away" virtual button. When the user touches the "away" virtual button, the electronic device is configured to generate an energy control signal correspondingly and send the energy control signal to the indoor unit 104 through a wireless network. The wireless network can be a wireless local area network or a mobile communication network.

For example, other controller may be a remote control of the air conditioning system 100. The remote control can be a handheld remote controller and the remote control may have an "away" physical button or an "away" touch button. When the user presses the "away" physical button or touches the "away" touch button, the remote control is configured to generate and send the energy control signal to the indoor unit 104. In this case, the controller 102 and the indoor unit 104 can transmit data to each other by an infrared wireless way.

Other controller may be a controller installed on the wall. The controller may have an "away" physical button or an "away" touch button. When the user presses the "away" physical button or touches the "away" touch button, the controller is configured to generate and send the energy control signal to the indoor unit 104. In this case, the controller 102 and the indoor unit 104 can transmit data to each other by a wireless way or a wired way.

It is to be understood that, the indoor unit 104 includes necessary hardware and/or software to implement the above data-transmission function with the controller 102. Additionally, the controller 102 has other functional buttons for the indoor unit 104, such as an "on/off" button, a "+" button, a "−" button and a "mode" button, etc.

It is noted that, the above "away" virtual button, the "away" physical button and the "away" touch button are an expression for a functional button for the indoor unit 104. Those skilled in the art can use other expressions to show this functional button. This functional button is convenient for people to make the air conditioning system 100 enter energy management mode when people leaves the indoor places. In this way, the energy management mode of the air conditioning system 100 can be set by pressing one button. This can reduce cumbersome user operations and extend the life of the controller 102.

The indoor unit 104 includes a controlling module 108 and a temperature sensor 110. The controlling module 108 is configured to receive the energy control signal sent by the controller 102 and determine current state of the indoor unit 104 according to the energy control signal. The controlling module 108 can be a controller set in the indoor unit 104.

In this embodiment, the state of the indoor unit includes an off state, a heating state, a cooling state, a fan state and a dry state.

The indoor unit 104 being under the off state means that, the indoor unit 104 is under the state after the indoor unit 104 is powered, or, when the "on/off" button on the controller 102 is pressed during the operation of the indoor unit 104, a state which the indoor unit 104 is under. Under the off state, when the "on/off" button of the controller 102 is pressed, the indoor unit 104 can operate under a default operating mode. Under the off state, the controlling mode 108 still can obtain an indoor temperature from the temperature sensor 110.

The indoor unit 104 being/operating under the heating state means that, when the user chooses a heating mode using the "mode" button on the controller 102, a state under which the indoor unit 104 operates according to preset heating parameters. For example, in one aspect, the controlling mode 108 calculates a heating demand of the indoor unit 104 according to a difference between a set heating temperature TS1 and a current indoor temperature T1 and sends the heating demand to the outdoor unit 106. In another aspect, the controlling module 108 controls opening degree of an electronic expansion valve of the indoor unit 104 according to a target degree of subcooling to adjust mass flow of the refrigerant in the air conditioning system 100. The outdoor unit 106 operates according to the heating demand and the mass flow of the refrigerant.

The indoor unit 104 being/operating under the cooling state means that, when the user chooses a cooling mode using the "mode" button on the controller 102, a state under which the indoor unit 104 operates according to preset cooling parameters. For example, in one aspect, the controlling module 108 calculates a cooling demand of the indoor unit 104 according to a difference between a set cooling temperature TS2 and a current indoor temperature T1 and sends the cooling demand to the outdoor unit 106. In another aspect, the controlling module 108 controls the opening degree of the electronic expansion valve of the indoor unit 104 according to an objective superheating degree to adjust the mass flow of the refrigerant in the air conditioning system 100. The outdoor unit 106 operates according to the cooling demand and the mass flow of the refrigerant.

The indoor unit 104 being/operating under the fan state means that, when the user chooses a fan mode using the "mode" button on the controller 102, a state under which the indoor unit 104 operates according to preset fan-mode parameters.

The indoor unit 104 being/operating under the dry state means that, when the user chooses a dry mode using the "mode" button on the controller 102, a state under which the indoor unit 104 operates according to preset dry-mode parameters.

Energy consumption of the outdoor unit 106 is proportional to the outdoor-unit energy demand and the mass flow of refrigerant. The greater the energy demand of the outdoor unit 106, the higher the energy consumption of the outdoor unit 106; the greater the mass flow of refrigerant, the higher the energy consumption of the outdoor unit 106. When one outdoor unit 106 is connected to one indoor unit 104, the outdoor-unit energy demand is equal to the energy demand (such as the heating demand or the cooling demand) of the indoor unit 104. When one outdoor unit 106 is connected to a number of indoor units 104, the outdoor-unit energy demand is equal to sum of the energy demands of the indoor units 104. Therefore, the energy demand of the indoor unit 104 directly influences the outdoor-unit energy demand.

The energy demand of the indoor unit 104 is a virtual number which the controlling module 108 of the indoor unit 104 calculates according to the difference between a set temperature TS and the current indoor temperature T1. When it is the cooling demand and T1≤TS, the cooling demand is equal to zero; when it is the cooling demand and T1>TS, the cooling demand is equal to a positive integer of 1 to 10. The greater the difference of T1 minus TS, the greater the energy demand, and minimum is 1, and maximum is 10.

When it is the heating demand and T1≥TS, the heating demand is equal to zero; when it is the heating demand and T1<TS, the heating demand is equal to a positive integer of 1 to 10. The greater the difference of TS minus T1, the greater the energy demand, and minimum is 1, and maximum is 10.

If the indoor unit 104 is under the off state, the controlling module 108 is configured to maintain the off state of the indoor unit 104, and determine whether the indoor temperature is smaller than a preset temperature. That is to say, when the indoor unit 104 is under the off state, the controlling module 108 obtains the indoor temperature from the temperature sensor 110 of the indoor unit 104. In this embodiment, the preset temperature is zero degrees Celsius. It is to be understood that, the preset temperature can be changed according to an applied environment of the air conditioning system 100 and practical use.

If the indoor temperature is smaller than the preset temperature, the controlling module 108 is configured to control the indoor unit to heat according to a first heating temperature, and increase a target degree of subcooling of the indoor unit 104. If the indoor temperature is not smaller than the preset temperature, the controlling module 108 is configured to maintain the off state of the indoor unit 104.

Specifically, the first heating temperature is smaller than a set heating temperature (hereafter a second heating temperature) according to which the indoor unit 104 operates under the heating state. In one example, under the heating state, the second heating temperature is 25~30 degrees Celsius. Under the energy management mode, the first heating temperature is 10 degrees Celsius. When the controlling module 108 controls the indoor unit 104 to heat according to the first heating temperature, the controlling module 108 is configured to send a first heating demand to the outdoor unit 106.

Generally, when the indoor unit 104 is under the heating state, the target degree of subcooling of the indoor unit 104 is 5~8 degrees Celsius. Under the energy management mode, in one example, the controlling module 108 increases the target degree of subcooling of the indoor unit 104 to 20 degrees Celsius. The greater the target degree of subcooling of the indoor unit 104, the smaller the opening degree of the electronic expansion valve of the indoor unit 104, and the smaller the mass flow of refrigerant.

Therefore, after receiving the energy control signal and when the indoor temperature is smaller than the preset temperature, in one aspect, the controlling module 108 controls the indoor unit 104 to heat, but controls the indoor unit 104 and the outdoor unit 106 to operate according to the first heating temperature which is smaller than the second heating temperature. In another aspect, the controlling module 108 decreases the mass flow of refrigerant to lower the energy consumption of the air conditioning system 100, such as the outdoor unit 106.

Therefore, the air conditioning system 100 can maintain an indoor place, especially an indoor place without people, under a relatively less-harsh environment. For example, the air conditioning system 100 can maintain the indoor place at about 10 degrees Celsius in the winter. This also ensures that the equipments of the indoor unit 104 will not be damaged by frost, and at the same time, energy can be saved. It is to be understood that, the first heating temperature and the increased target degree of subcooling can be changed according to factors such as, the applied environment of the air conditioning system 100, etc.

If the indoor unit 104 is under the heating state, the controlling module 108 is configured to set the second heating temperature of the indoor unit 104 to the first heating temperature, and control the indoor unit 104 to heat according to the first heating temperature, and increase the target degree of subcooling of the indoor unit 104. The first heating temperature is smaller than the second heating temperature.

Similarly, when the indoor unit 104 is under the heating state, the controlling module 108 controls the indoor unit 104 to heat according to the first heating temperature which is smaller than the second heating temperature and increases the target degree of subcooling to 20 degrees Celsius to control operations of the indoor unit 104 and the outdoor unit 106. Thus, energy can be saved.

If the indoor unit 104 is under the cooling state, the controlling module 108 is configured to set a first cooling temperature of the indoor unit to a second cooling temperature and control the indoor unit 104 to cool according to the second cooling temperature, and increase an objective superheating degree of the indoor unit 104. The second cooling temperature is greater than the first cooling temperature.

Specifically, for example, when the indoor unit 104 is under the cooling state, the first cooling temperature is 17~26 degrees Celsius. Under the energy management mode, the second cooling temperature is 30 degrees Celsius. When the controlling module 108 controls the indoor unit 104 to cool according to the second cooling temperature, the controlling module 108 is configured to send a first cooling demand to the outdoor unit 106.

Generally, when the indoor unit 104 is under the cooling state, the objective superheating degree of the indoor unit 104 is about 1~5 degrees Celsius. Under the energy management mode, in one example, the controlling module 108 increases the objective superheating degree of the indoor unit 104 to 10 degrees Celsius. The greater the objective superheating degree of the indoor unit 104, the smaller the opening degree of the electronic expansion valve of the indoor unit 104, and the smaller the mass flow of refrigerant.

Therefore, after receiving the energy control signal and determining that the indoor unit 104 is under the cooling state, in one aspect, the controlling module 108 controls the indoor unit 104 to cool, but controls the indoor unit 104 and the outdoor unit 106 to operate according to the second cooling temperature which is greater than the first cooling temperature. In another aspect, the controlling module 108 decreases the mass flow of refrigerant to lower the energy consumption of the air conditioning system 100, such as the outdoor unit 106.

Therefore, the air conditioning system 100 can maintain the indoor place, especially the indoor place without people, under a relatively less-harsh environment. For example, the air conditioning system 100 can maintain the indoor place at about 30 degrees Celsius in the summer. This also maintains cooling comfort of the indoor place without people while saving energy. It is to be understood that, the second cooling temperature and the increased objective superheating degree can be changed according to factors such as, the applied environment of the air conditioning system 100, etc.

If the indoor unit 104 is under the fan state, the controlling module 108 is configured to turn off the indoor unit 104, and determine whether the indoor temperature is smaller than the preset temperature. If the indoor temperature is smaller than the preset temperature, the controlling module 108 is configured to control the indoor unit 104 to heat according to the first heating temperature, and increase the target degree of subcooling of the indoor unit 104. If the indoor temperature is not smaller than the preset temperature, the controlling module 108 is configured to maintain the off state of the indoor unit 104.

If the indoor unit 104 is under the dry state, the controlling module 108 is configured to turn off the indoor unit 104 and determine whether the indoor temperature is smaller than the preset temperature. If the indoor temperature is smaller than the preset temperature, the controlling module 108 is configured to control the indoor unit 104 to heat according to the first heating temperature, and increase the target degree of subcooling of the indoor unit 104. If the indoor temperature is not smaller than the preset temperature, the controlling module 108 is configured to maintain the off state of the indoor unit 104.

Similarly, when the controlling module 108 receives the energy control signal and determines that the indoor unit 104 is under the fan state or the dry state, in one aspect, the controlling module 108 turns off the indoor unit 104 to reduce energy consumption. In another aspect, when the indoor temperature is smaller than the preset temperature, such as zero degrees Celsius, the controlling module 108 controls the indoor unit 104 to heat according to the first heating temperature which is smaller than the second heating temperature, and increases the target degree of subcooling. This ensures that the related equipments of the indoor unit 104 will not be damaged by frost, and at the same time, energy can be saved. Furthermore, the air conditioning system 100 can determine more states of the indoor unit 104, which enlarges application scope of the air conditioning system 100.

Preferably, the controlling module 108 is further configured to reduce the first heating demand to a second heating demand, and send the second heating demand to the outdoor unit 106. For example, the second heating demand is 30% of the first heating demand. Thus, the outdoor unit 106 can operate according to a smaller heating demand, which further reduces energy consumption of the air conditioning system 100.

The controlling module 108 is further configured to reduce the first cooling demand to a second cooling demand, and send the second cooling demand to the outdoor unit 106. For example, the second cooling demand is 30% of the first cooling demand. Thus, the outdoor unit 106 can operate according to a smaller cooling demand, which further reduces energy consumption of the air conditioning system 100.

In the air conditioning system 100 of this embodiment, when receiving the energy control signal of the user, the controlling module 108 controls the indoor unit 104 to operate according to different states of the indoor unit 104. This can balance the cooling comfort and energy saving problems of the air conditioning system 100 in the summer, and balance anti-freezing and energy saving problems of the air conditioning system 100 in the winter.

Figure 2:
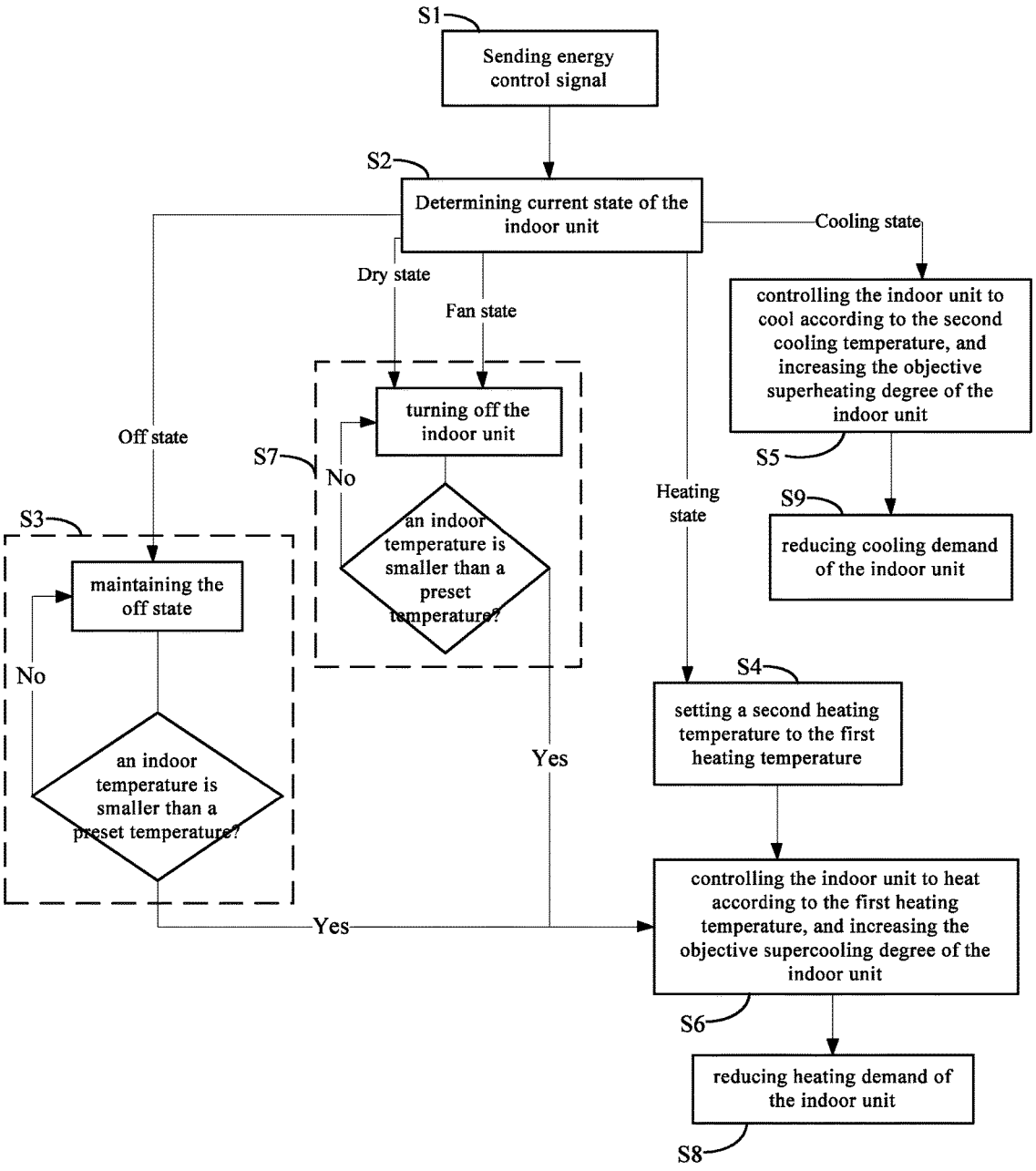
FIG. 2 is a flow chart of an energy management method of an air conditioning system, according to another embodiment of the present disclosure.

Referring to FIG. 2, an energy management method of an air conditioning system, according to another embodiment of the present disclosure, is provided. The energy management method can be implemented by the above air conditioning system 100. The energy management method includes following steps of:

S1: the controller 102 sending an energy control signal to the controlling module 108;

S2: the controlling module 108 receiving the energy control signal and determining current state of the indoor unit 104 according to the energy control signal, if the indoor unit 104 is under off state, entering step S3, and if the indoor unit 104 is under heating state, entering step S4, and if the indoor unit 104 is under cooling state, entering step S5;

S3: the controlling module 108 maintaining the off state of the indoor unit 104, and determining whether an indoor temperature is smaller than a preset temperature, if the indoor temperature is smaller than the preset temperature, entering step S6, if the indoor temperature is not smaller than the preset temperature, continuing the step S3;

S4: the controlling module 108 setting a second heating temperature of the indoor unit 104 to a first heating temperature, and entering the step S6;

S5: the controlling module 108 setting a first cooling temperature of the indoor unit 104 to a second cooling temperature and controlling the indoor unit 104 to cool according to the second cooling temperature, and increasing a target degree of superheating of the indoor unit 104, the second cooling temperature being greater than the first cooling temperature; and S6: the controlling module 108 controlling the indoor unit 104 to heat according to the first heating temperature, and increasing the target degree of subcooling of the indoor unit 104, the first heating temperature being smaller than the second heating temperature.

In the step S1, the user can input a control instruction using the physical button or the virtual button on the controller 102. The controller 102 generates the energy control signal according to the user's input and sends the energy control signal to the indoor unit 104 through a wireless way or a wired way.

In the step S2, after receiving the energy control signal, the controlling module 108 determines the current state of the indoor unit 104. The state of the indoor unit 104 includes the off state, the heating state, the cooling state, a fan state and a dry state in this embodiment.

In the step S3, i.e., when the indoor unit 104 is under the off state, the controlling module 108 obtains the indoor temperature from the temperature sensor 110 and compares the indoor temperature to the preset temperature. The controlling module 108 determines whether anti-freezing measures of the indoor unit 104 should be taken by comparing temperatures.

In the step S4, i.e., when the indoor unit 104 is under the heating state, the controlling module 108 reduces the heating temperature of the indoor unit 104 to save energy.

In the step S5, i.e., when the indoor unit 104 is under the cooling state, the controlling module 108 controls the indoor unit 104 to operate according to the second cooling temperature which is greater than the first cooling temperature and increases the objective superheating degree to 10 degrees Celsius to control operation of the indoor unit 104 and the outdoor unit 106.

In the step S6, the controlling module 108 controls the indoor unit 104 to heat according to the first heating temperature which is smaller than the second heating temperature, and increases the target degree of subcooling of the indoor unit 104 to 20 degrees Celsius to control the operations of the indoor unit 104 and the outdoor unit 106.

Preferably, the step S1 includes: if the indoor unit 104 is under the fan state or the dry state, entering step S7.

The energy management method further includes a step of: S7: the controlling module 108 turning off the indoor unit 104 and determining whether the indoor temperature is smaller than the preset temperature, If the indoor temperature is smaller than the preset temperature, entering the step S6, if the indoor temperature is not smaller than the preset temperature, continuing the step S7.

In the step S7, after the controlling module 108 receives the energy control signal and determines the indoor unit 104 is under the fan state or the dry state, in one aspect, the controlling module 108 turns off the indoor unit 104 to reduce energy consumption. In another aspect, the controlling module 108 obtains the indoor temperature from the temperature sensor 110 of the indoor unit 104, and compares the indoor temperature to the preset temperature. The controlling module 108 determines whether anti-freezing measures of the indoor unit 104 should be taken by comparing temperatures. If yes, enter the step S6. Furthermore, the energy management method can determine more states of the indoor unit 104, which enlarges usage scope of the energy management method.

Furthermore, the step S6 includes: when the controlling module 108 controls the indoor unit 104 to heat according to the first heating temperature, the controlling module 108 sending a first heating demand to the outdoor unit 106.

After the step S6, the energy management method includes a step of:

S8: the controlling module 108 reducing the first heating demand to a second heating demand, and sending the second heating demand to the outdoor unit 106.

The step S5 includes: when the controlling module 108 controls the indoor unit 104 to cool according to the second cooling temperature, the controlling module 108 sending a first cooling demand to the outdoor unit 106.

After the step S5, the energy management method further includes a step of:

S9: the controlling module 108 reducing the first cooling demand to a second cooling demand, and sending the second cooling energy to the outdoor unit 106.

In the step S8, in this embodiment, the second heating demand is 30% of the first heating demand. Therefore, the outdoor unit 106 operates according to a smaller heating demand, which further reduces energy consumption of the air conditioning system 100.

In the step S9, in this embodiment, the second cooling demand is 30% of the first cooling demand. Therefore, the outdoor unit 106 operates according to a smaller cooling demand, which further reduces energy consumption of the air conditioning system 100.

Other detailed descriptions of the energy management method in this embodiment can be referred to similar detailed descriptions of the air conditioning system 100 in the above embodiment.

In the energy management method of the air conditioning system 100 in this embodiment, when receiving the energy control signal of the user, the controlling module 108 controls the indoor unit 104 to operate according to different states of the indoor unit 104. This can balance the cooling comfort and energy saving problems of the air conditioning system 100 in the summer, and balance anti-freezing and energy saving problems of the air conditioning system 100 in the winter.

Reference throughout this specification to "an embodiment", "some embodiments", "one embodiment", "an example", "a specific example", or "some examples" means that a particular feature, structure, material, or characteristic described in connection with the embodiment or example is included in at least one embodiment or example of the disclosure. In the descriptions, expressions of the above terms does not need for same embodiments or examples. Furthermore, the feature, structure, material, or characteristic described can be incorporated in a proper way in any one or more embodiments or examples. In addition, under non-conflicting condition, those skilled in the art can incorporate or combine features described in different embodiments or examples.

Although explanatory embodiments have been shown and described, it would be appreciated by those skilled in the art that changes, alternatives, and modifications may be made in the embodiments without departing from spirit and principles of the disclosure. Such changes, alternatives, and modifications all fall into the scope of the claims and their equivalents.

What is claimed is:

1. An air conditioning system, comprising a controller and an indoor unit, the indoor unit comprising a controlling module, the controller being configured to send an energy control signal to the controlling module, the controlling module being configured to receive the energy control signal and determine a state of the indoor unit according to the energy control signal, states of the indoor unit comprising an off state, a heating state and a cooling state;

if the indoor unit is under the off state, the controlling module being configured to maintain the off state of the indoor unit, and determine whether an indoor temperature is smaller than a preset temperature;

if the indoor temperature is smaller than the preset temperature, the controlling module being configured to control the indoor unit to heat according to a first heating temperature, and increase a target degree of subcooling of the indoor unit;

if the indoor temperature is not smaller than the preset temperature, the controlling module being configured to maintain the off state of the indoor unit;

if the indoor unit is under the heating state, the controlling module being configured to set a second heating temperature of the indoor unit to the first heating temperature, and control the indoor unit to heat according to the first heating temperature, and increase the target degree of subcooling of the indoor unit, the first heating temperature being smaller than the second heating temperature;

if the indoor unit is under the cooling state, the controlling module being configured to set a first cooling temperature of the indoor unit to a second cooling temperature and control the indoor unit to cool according to the second cooling temperature, and increase a target degree of superheating of the indoor unit, the second cooling temperature being greater than the first cooling temperature;

the air conditioning system comprising an outdoor unit, when the controlling module controls the indoor unit to heat according to the first heating temperature, the controlling module being configured to send a first heating demand to the outdoor unit;

the controlling module being further configured to reduce the first heating demand to a second heating demand, and send the second heating demand to the outdoor unit;

when the controlling module controls the indoor unit to cool according to the second cooling temperature, the controlling module being configured to send a first cooling demand to the outdoor unit;

the controlling module being further configured to reduce the first cooling demand to a second cooling demand, and send the second cooling demand to the outdoor unit.

2. The air conditioning system of claim 1, wherein the states of the indoor unit comprise a fan state, and if the indoor unit is under the fan state, the controlling module is configured to turn off the indoor unit, and determine whether the indoor temperature is smaller than the preset temperature;

if the indoor temperature is smaller than the preset temperature, the controlling module is configured to control the indoor unit to heat according to the first heating temperature, and increase the target degree of subcooling of the indoor unit;

if the indoor temperature is not smaller than the preset temperature, the controlling module is configured to maintain the off state of the indoor unit.

3. The air conditioning system of claim 1, wherein the states of the indoor unit comprise a dry state, and if the indoor unit is under the dry state, the controlling module is configured to turn off the indoor unit and determine whether the indoor temperature is smaller than the preset temperature;

if the indoor temperature is smaller than the preset temperature, the controlling module is configured to control the indoor unit to heat according to the first heating temperature, and increase the target degree of subcooling of the indoor unit;

if the indoor temperature is not smaller than the preset temperature, the controlling module is configured to maintain the off state of the indoor unit.

4. The air conditioning system of claim 1, wherein the second heating demand is 30% of the first heating demand, and the second cooling demand is 30% of the first cooling demand.

5. An energy management method of an air conditioning system, the air condition system comprising a controller and an indoor unit, the indoor unit comprising a controlling module, states of the indoor unit comprising an off state, a heating state and a cooling state, the energy management method comprising following steps of:

S1: the controller sending an energy control signal to the controlling module;

S2: the controlling module receiving the energy control signal and determining current state of the indoor unit according to the energy control signal, if the indoor unit is under the off state, entering step S3, and if the indoor unit is under the heating state, entering step S4, and if the indoor unit is under the cooling state, entering step S5;

S3: the controlling module maintaining the off state of the indoor unit, and determining whether an indoor temperature is smaller than a preset temperature, if the indoor temperature is smaller than the preset temperature, entering step S6, if the indoor temperature is not smaller than the preset temperature, continuing the step S3;

S4: the controlling module setting a second heating temperature of the indoor unit to a first heating temperature, and entering step S6;

S5: the controlling module setting a first cooling temperature of the indoor unit to a second cooling temperature and controlling the indoor unit to cool according to the second cooling temperature, and increasing a target degree of superheating of the indoor unit, the second cooling temperature being greater than the first cooling temperature;

S6: the controlling module controlling the indoor unit to heat according to the first heating temperature, and increasing a target degree of subcooling of the indoor unit, the first heating temperature being smaller than the second heating temperature;

the air conditioning system comprising an outdoor unit, the step S6 comprising: when the controlling module controls the indoor unit to heat according to the first heating temperature, the controlling module sending a first heating demand to the outdoor unit;

after the step S6, the energy management method further comprising a step of:

S8: the controlling module reducing the first heating demand to a second heating demand, and sending the second heating demand to the outdoor unit;

the step S5 comprising: when the controlling module controls the indoor unit to cool according to the second cooling temperature, the controlling module sending a first cooling demand to the outdoor unit;

after the step S5, the energy management method further comprising a step of:

S9: the controlling module reducing the first cooling demand to a second cooling demand, and sending the second cooling demand to the outdoor unit.

6. The energy management method of claim 5, wherein the states of the indoor unit comprise a fan state, and the step S1 comprises: if the indoor unit is under the fan state, entering step S7;

the energy management method comprises a step of:

S7: the controlling module turning off the indoor unit, and determining whether the indoor temperature is smaller than the preset temperature, if the indoor temperature is smaller than the preset temperature, entering the step S6, if the indoor temperature is not smaller than the preset temperature, continuing the step S7.

7. The energy management method of claim 5, wherein the states of the indoor unit comprise a dry state, and the step S1 comprises: if the indoor unit is under the dry state, entering step S7;

the energy management method comprises a step of:

S7: the controlling module turning off the indoor unit and determining whether the indoor temperature is smaller than the preset temperature, if the indoor temperature is smaller than the preset temperature, entering the step S6, if the indoor temperature is not smaller than the preset temperature, continuing the step S7.

8. The energy management method of claim 5, wherein the second heating demand is 30% of the first heating demand, and the second cooling demand is 30% of the first cooling demand.

* * * * *